US005361897A

United States Patent [19]

Poehler

[11] Patent Number: 5,361,897

[45] Date of Patent: Nov. 8, 1994

[54] KIT OF LIBRARY FORMS

[76] Inventor: Oliver Poehler, 920 W. Elm, Wheaton, Ill. 60187

[21] Appl. No.: 133,994

[22] Filed: Oct. 12, 1993

[51] Int. Cl.[5] ..... B65D 85/00

[52] U.S. Cl. ..... 206/232; 281/15.1

[58] Field of Search ..... 206/232, 459.5, 460; 229/69, 72; 281/42, 44, 15.1; 283/55, 61, 63.1, 65

[56] References Cited

U.S. PATENT DOCUMENTS

| | | | |
|---|---|---|---|
| 1,766,006 | 6/1930 | Tees | 206/232 |
| 3,295,746 | 1/1967 | Duncan | 206/232 |
| 4,148,430 | 4/1979 | Drake | 229/69 |
| 4,434,889 | 3/1984 | Fery | 206/232 |
| 4,706,996 | 11/1987 | Fasham | 206/232 |
| 4,776,510 | 10/1988 | Jenkins | 229/69 |
| 4,779,791 | 10/1988 | Wyant | 229/72 |
| 4,867,310 | 9/1989 | Cannon et al. | 206/232 |

*Primary Examiner*—Jimmy G. Foster
*Attorney, Agent, or Firm*—Patnaude, Videbeck & Marsh

[57] ABSTRACT

A carrier sheet includes two blank librarian's card forms, a plurality of spine labels, and two standard library book pockets all positioned to be printed in a single computer printing operation. The spine labels and the book pockets have pressure sensitive adhesive backings and are adapted to be peeled off of the carrier sheet for attachment to an associated book.

7 Claims, 1 Drawing Sheet

KIT OF LIBRARY FORMS

The present invention relates in general to forms for use by libraries for controlling records relating to the identifacation and inventory of books in the libraries, and it relates in particular to a new and improved kit which includes one or more librarian's cards and one or more standard library book pockets affixed together to permit printing of the usual information on both the cards and the pockets in a single typing and printing operation.

BACKGROUND OF THE INVENTION

The normal record keeping procedures of libraries includes a librarian's card for each book in the library, a book pocket for each book, and an identification label which is affixed to the spine of each book and which indicates the classification of the particular book according to the Dewey Decimal system. Usually, the name of the author, the title of the book, and the Dewey decimal classification number are printed on the upper portion of the librarian's card which is then kept in a file and used to indicate the name of the borrower of the book and the date when the book is due back at the library. In some cases a bar code number which identifies the book is also printed on the librarian's card. The same information identifying the book which is printed on the librarian's card is also printed on the front face of the book pocket, and where a universal bar code is used, the bar code may also be printed directly on the bottom portion of the book pocket.

The librarian's cards, the book labels, and the book pockets are generally purchased by the libraries as blank forms, and the information identifying the individual books is then typed and printed on the cards and pockets as new books are added to the inventory of the library. In the past the typing of the information on the book pockets, on the labels and on the librarian's cards has entailed two separate typing and printing operations. To solve the problem specially constructed book pockets have been attached to a librarian's card, but this has not proven to be successful because it entails the use of special printers. Also, these pockets are less satisfactory than the standard book pocket which has been in use for the last several decades and has proven to be durable and easy to use.

It would be desirable to provide a new and improved kit of forms which incorporates one or more standard book pockets in conjunction with one or more standard librarian's cards in such a manner as to permit both the book pocket and the associated librarian's card to be typed and printed in a single operation, thereby facilitating the use of the book pocket and the librarian's card. It would be further desirable to incorporate in the kit the necessary book labels which could thus be printed at the same time that the librarian's card and the book pocket are printed and later removed for attachment to the spine of the associated book.

SUMMARY OF THE INVENTION

Briefly, there is provided in accordance with the present invention a new and improved kit of library forms which includes a center portion made up of two adjacent blank librarian's cards to either side of which are respectively attached silicone coated sheets to which standard book pockets are removably secured. The rear faces of the book pockets are coated with a pressure sensitive adhesive so as to permit the pockets to be easily stuck to the inner sides of the covers of the associated books after the necessary information has been printed on the face of the book pockets.

Attached to the bottom edges of the librarian's card section of the kit are two tear off strips each containing two peel off book identification labels for removal and attachment to the spines of the associated books.

Each form kit is preferably a part of a continuous sheet of forms having perforated upper and lower edges to permit feeding of the form kits through a printing station by a standard computer printer tractor feed system while permitting removal of each kit from the continuous sheet of forms.

GENERAL DESCRIPTION OF THE DRAWING

The present invention will be better and more completely understood from a reading of the following detailed description of the invention taken in connection with the accompanying drawing wherein:

FIG. 1 is a front view of a library form kit embodying the present invention; and FIG. 2 is an elevational view taken from the bottom of the form kit shown in FIG. 1.

DETAILED DESCRIPTION OF THE INVENTION

Figure 1:
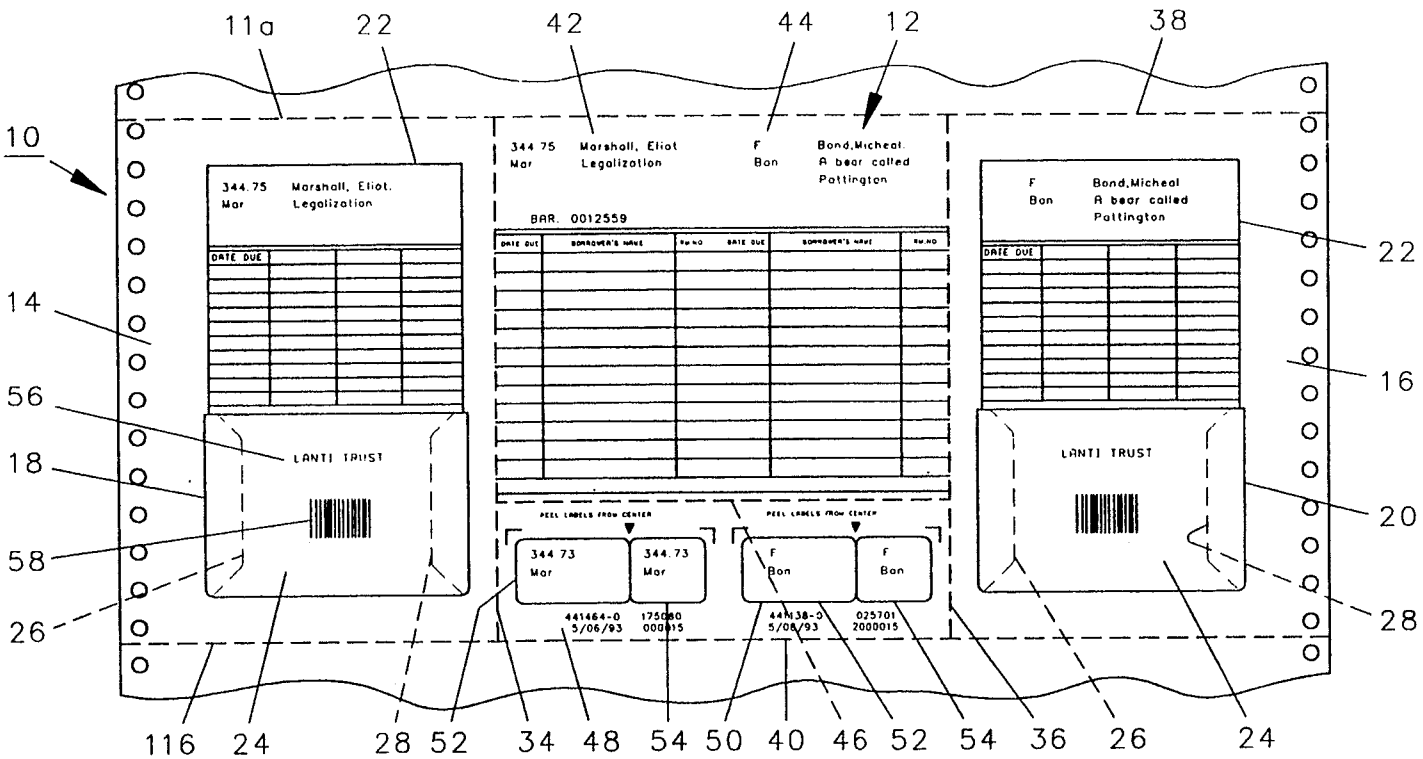
Figure 2:
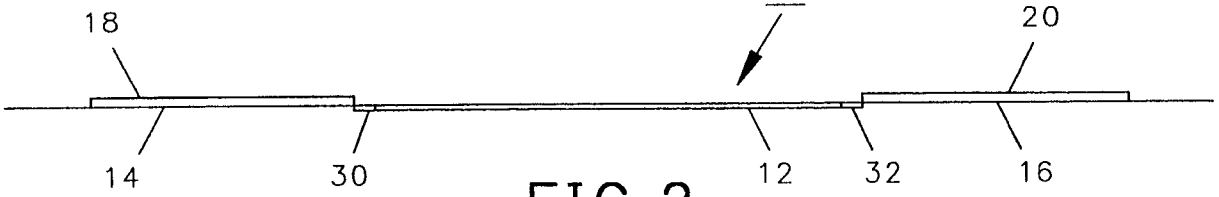

Referring to the drawing there is shown a plurality of library related, record keeping documents which are attached together into a single integral kit of forms 10 which is adapted to be printed in its entirety with information relating to two separate books in a conventional computer printer. While only one form 10 is shown in its entirety in the drawing, it will be understood by those skilled in the art that identical blank forms can be removably attached to the top and bottom edges of the form 10 by perforations 11*a* and 11*b* as illustrated in FIG. 1 to provide a continuous sheet of the forms 10 for use with the standard feed mechanism of a conventional computer printer.

Each form 10 includes a relatively stiff, cardboard central section 12 and a pair of silicone coated sheets 14 and 16 to which standard book pockets 18 and 20 are respectively attached. The pockets 18 and 20 are coated on the rear sides thereof with a pressure sensitive adhesive which permits the pockets to be peeled from the sheets 14 and 16 and permanently attached to the inside cover of a book.

The pockets 18 and 20 are of the standard design and are respectively made from a single sheet of paper which is folded over to provide a rear part 22 over the lower portion of which is located a front pocket part 24. The front pocket 24 is held in place by a pair of flaps 26 and 28 which are glued to the rear side of the part 22, It will be seen that a pocket is thus formed between the lower portion of the rear part 22 and the part 24, This pocket has the exact width of the rear part 22 and is constructed to have a sufficient thickness to readily receive a standard library book card.

The inner edge portions of the silicone coated sheets 14 and 16 overlap the side edge portions of the section 12 and are bonded thereto along narrow strips 30 and 32 adjacent lines of perforations 34 and 36 which permit separation of the central section 12 from the sheets 14 and 16.

Each of the forms 10 is connected to the forms adjacent thereto by lines of perforations 38 and 40 at the top and bottoms thereof to permit separation of the forms 10 from one another.

The central section 12 includes a pair of blank librarian's cards 42 and 44 which in use are cut apart along the vertical line which separates the cards from one another. In normal use the librarians type the necessary information relating to two books on the two librarian's cards in the same typing operation. Below the librarian's cards and connected thereto along a line of perforations 46 are a pair of sections 48 and 50 to which two sets of spine labels 52 and 54 are removably attached. The spine labels are of two different widths for attachment to the spines of the associated books.

In use the librarian types whatever information is necessary relating to two different books on the top portions of the librarian's cards 42 and 44 as well as on the lower face portions of the book pockets 18 and 20 and on the spine labels. If desired, the name of the donor of the book may be typed on the face of the book pocket as shown at 56. Moreover, there is space on the face of the book pocket to permit a universal code symbol to be applied thereto as shown at 58.

After completion of the typing operation in which the book identification information is printed by a conventional computer printer on the librarian's cards, on the book pockets, and on the spine labels, the form 10 is torn from the next adjacent form. The form 10 is then placed in a slitter which cuts the form 10 along a vertical line between the librarian's cards 42 and 44. The sections 48 and 50 are then torn from the respective librarian's cards and the appropriate ones of the spine labels are peeled off and applied to the spines of the respective books. The sections 48 and 50 can then be discarded. The book pockets are similarly peeled off of the associated sheets and affixed to the inside covers of the respective books. The librarian's cards are then torn from the adjacent sheets along the lines of perforations 34 or 36 and placed in the file where such cards are stored.

It will be seen by those skilled in this art that the kit of forms 10 greatly facilitates the entering of the necessary book identification information on each of the forms normally used for maintaining the records of books in a library using standard book pockets, librarian's cards, and spine labels.

While the present invention has been described in connection with a particular embodiment thereof, it will be understood that those skilled in the art may make many changes and modifications without departing from the true spirit and scope of the invention. Therefore, it is intended by the appended claims to cover all such changes and modifications which come within the true spirit and scope of the invention.

What is claimed:

1. A kit of forms for use in keeping records of books in libraries, comprising in combination a first, relatively stiff card section containing a librarian's card which is adapted to receive information to be printed thereon, said card section having at least one vertical edge portion, and a rear face and a front face adapted to receive printed information thereon, a first sheet section which is coplanar with said card section and removably attached thereto along one vertical edge portion of said sheet section and said vertical edge portion of said card section, a library book pocket constructed from a single sheet of paper and including a rear portion having front and rear faces, a front portion extending from the bottom of said rear portion and folded over the lower portion of said front face of said rear portion, and first and second side tab portions extending laterally from one of said rear and front portions and overlying the side edges of the other of said front and rear portions to form a pocket between said front, rear and side tab portions suitable for receiving a library book card, said front face of said rear portion and the front face of said front portion being adapted to receive information to be printed thereon, said rear portion of said library book pocket having on the rear face thereof a coating of a pressure sensitive adhesive, said first sheet section having a front face having a surface characteristic to which a pressure adhesive may be removably secured, and said rear face of said rear portion being positioned against said front face of said sheet section and removably affixed thereto by said pressure sensitive adhesive.

2. A kit of forms according to claim 1, comprising a second relatively stiff card section attached to said first card section along a vertical edge of said first card section in coplanar relationship with said first card section, a second sheet section which is coplanar with said card sections and removably attached to the outer edge of said second card section along the vertical edge remote from said first sheet section, and a second library book pocket having a pressure sensitive adhesive provided on the rear side thereof, said second library book pocket being removably secured to the front face of said second sheet section.

3. A kit according to claim 1, comprising one or more spine labels having pressure sensitive adhesive on the rear faces thereof, said spine labels being removably secured to the front face of said first card section with said rear faces of said spine labels being positioned against said front face of said first card section.

4. A kit according to claim 3 wherein a line of perforations is provided between said librarian's card and the portion of said card section to which said spine labels are removably secured.

5. A kit according to claim 1 wherein said kit is part of a continuous sheet of a plurality of said kits, and wherein said kits are adapted to be torn apart from one another.

6. A kit according to claim 1 wherein a line of perforations is provided along said first card section adjacent said first sheet section.

7. A kit according to claim 1 wherein:

said information includes a universal bar code symbol.

* * * * *